US007596815B2

(12) United States Patent
Grilliot et al.

(10) Patent No.: US 7,596,815 B2
(45) Date of Patent: Oct. 6, 2009

(54) PROTECTIVE GARMENT HAVING LOWER TORSO-COVERING AND LEG-COVERING PORTIONS AND EQUIPPED WITH DRAG HARNESS OR DRAG HARNESSES

(75) Inventors: William L. Grilliot, Dayton, OH (US); Mary I. Grilliot, Dayton, OH (US); Patricia K. Waters, Tipp City, OH (US); Douglas Sloan, Douglaston, NY (US); John J. Reilly, Rockville Centre, NY (US); Michael P. Harty, West Islip, NY (US); Francis T. Haskell, West Islip, NY (US); Thomas J. Fee, Hempstead, NY (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 252 days.

(21) Appl. No.: 11/796,642

(22) Filed: Apr. 27, 2007

(65) Prior Publication Data

US 2008/0263755 A1 Oct. 30, 2008

(51) Int. Cl.
*A41D 13/00* (2006.01)
*A62B 35/00* (2006.01)

(52) U.S. Cl. ..... 2/227; 2/81; 2/24

(58) Field of Classification Search ..... 2/227, 2/228, 231, 232, 233, 238, 22, 23, 24, 455–458, 2/69, 79, 81, 83, 114, 247, 911, 919, 300, 2/301, 311–314, 318, 338, 229, 230, 94; 182/3, 4; 244/143, 151 R See application file for complete search history.

(56) References Cited

U.S. PATENT DOCUMENTS

| | | | | | |
|---|---|---|---|---|---|
| 1,337,901 | A | * | 4/1920 | Godward | 2/233 |
| 1,446,251 | A | * | 2/1923 | Goldsmith | 2/23 |
| 4,599,750 | A | * | 7/1986 | Rahaman | 2/243.1 |
| 4,613,991 | A | * | 9/1986 | Grover | 2/23 |
| 4,682,671 | A | * | 7/1987 | Hengstenberger et al. | 182/3 |
| 4,910,802 | A | * | 3/1990 | Malloy | 2/69 |
| 5,036,548 | A | * | 8/1991 | Grilliot et al. | 2/81 |
| 5,289,590 | A | * | 3/1994 | Larson | 2/227 |
| 5,308,305 | A | * | 5/1994 | Romney | 482/124 |
| 5,799,328 | A | * | 9/1998 | Harlem et al. | 2/69 |
| 5,926,851 | A | * | 7/1999 | Kovalik | 2/227 |
| 5,970,517 | A | * | 10/1999 | Jordan | 2/69 |
| 6,134,713 | A | * | 10/2000 | De Rosa et al. | 2/94 |

(Continued)

*Primary Examiner*—Amy B Vanatta
(74) *Attorney, Agent, or Firm*—Wood, Phillips, Katz, Clark & Mortimer

(57) ABSTRACT

As worn by a firefighter or by an emergency rescue worker, a protective garment having a lower torso-covering portion and two leg-covering portions is equipped with a drag harness or drag harnesses. Each drag harness is accessible through an aperture or apertures somewhere in the lower torso-covering and leg-covering portions. In the illustrated and described embodiments, the protective garment is equipped with two knee pads. Each knee pad is manipulatable between a position wherein such knee pad covers the aperture or apertures in a given one of the leg-covering portions and positions wherein such knee pad does not cover the aperture or apertures in the given one of the leg-covering portions. Each knee pad may serve as a flap or may be completely detachable.

5 Claims, 1 Drawing Sheet

U.S. PATENT DOCUMENTS 6,256,789 B1 * 7/2001 Young et al. ..... 2/69
6,317,894 B1 * 11/2001 Blechman ..... 2/269
6,658,666 B2 * 12/2003 Schweer ..... 2/94
7,194,770 B1 * 3/2007 Fecenko ..... 2/227
2007/0157362 A1 * 7/2007 Rogers ..... 2/114
2007/0169246 A1 * 7/2007 Sloan et al. ..... 2/81
2008/0083049 A1 * 4/2008 McLeod ..... 2/83
2008/0256678 A1 * 10/2008 Grilliot et al. ..... 2/69

* cited by examiner

PROTECTIVE GARMENT HAVING LOWER TORSO-COVERING AND LEG-COVERING PORTIONS AND EQUIPPED WITH DRAG HARNESS OR DRAG HARNESSES

TECHNICAL FIELD OF THE INVENTION

This invention pertains to a protective garment of a type worn by a firefighter or by an emergency rescue worker, and of a type having a lower torso-covering portion and two leg-covering portions. This invention provides such a garment with a drag harness or drag harnesses.

BACKGROUND OF THE INVENTION

As worn by firefighters and by emergency rescue workers, protective garments of the type having a lower torso-covering portion and two leg-covering portions noted above include protective pants, protective overalls, and protective coveralls. Herein, the lower torso-covering portion refers to the portion comprising and extending downwardly from the waist to the leg-covering portions and covering, among other regions, the groin and buttocks regions of the wearer.

Commonly, a firefighter or an emergency rescue worker who wears a protective garment of the type noted above also wears a drag harness, which is a harness used by a rescuer to drag a stricken wearer from a perilous situation. Such a harness may be also called a drag rescue device.

Drag harnesses, as discussed in the preceding paragraph, are exemplified in U.S. Pat. No. 4,682,671, No. 4,854,418, and No. 6,205,584 B1, and in United States Patent Application Publications No. US 2005/0173188 A1 and No. US 2005/0211188 A1.

SUMMARY OF THE INVENTION

This invention provides a protective garment of a type worn by a firefighter or by an emergency rescue worker, and of a type having a lower torso-covering portion and two leg-covering portions. Broadly, the protective garment is equipped with a drag harness or with drag harnesses, each of which is accessible through an associated aperture or associated apertures located somewhere in the lower torso-covering and leg-covering portions.

As indicated above, the lower torso-covering portion refers to the portion comprising and extending downwardly from the waist to the leg-covering portions and covering, among other regions, the groin and buttocks regions of the wearer. Broadly, the associated aperture or associated apertures may be located in a pocket, under a flap, or under a knee pad.

Along with each drag harness, the protective garment may be also equipped with a flap, which is manipulatable between a position wherein the flap covers the aperture or apertures associated with said drag harness and positions wherein the flap does not cover the aperture or apertures associated with said drag harness.

Along with each drag harness, the protective garment may be also equipped with a knee pad, which is manipulatable between a position wherein the knee pad covers the aperture or apertures associated with said drag harness and positions wherein the knee pad does not cover the aperture or apertures associated with said drag harness.

So as to be manipulatable therebetween, the knee pad may be attached to the given one of the leg-covering portions so as to be completely detachable or, in a variation wherein the knee pad serves as a flap, so as to be completely detachable, except for being attached hingedly to the given one of the leg-covering portions, along an edge portion of the knee pad.

Preferably, the drag harness extends into the protective garment, through a pair of apertures associated with said drag harness. Alternatively, the drag harness extends into the protective garment, through a single aperture associated with said drag harness.

BRIEF DESCRIPTION OF THE DRAWINGS

FIG. 1 is a fragmentary, pictorial view of one contemplated embodiment of a protective garment embodying this invention, while

DETAILED DESCRIPTION OF THE ILLUSTRATED EMBODIMENTS

Figure 1:
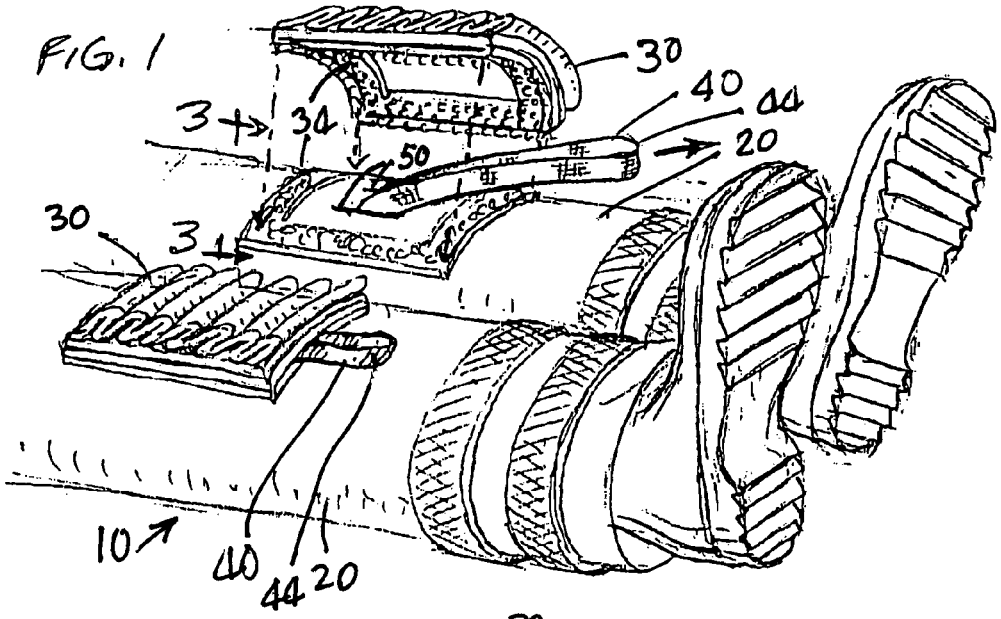

In each illustrated embodiment, a protective garment 10 of a type worn by a firefighter or by an emergency rescue worker, such as a pair of protective pants, a suit of protective overalls, or a suit of protective coveralls, has a lower torso-covering portion 12 and two leg-covering portions 20 and is equipped at each leg-covering portion 20 with a knee pad 30 and with a drag harness 40, which is accessible through a pair of apertures 50 in said leg-covering portion 20 when the knee pad 30 does not cover the pair of apertures 50. If the protective garment 10 has an outer shell and a liner or liners, the apertures 50 extend through the outer shell and through the liner or liners.

Figure 3:
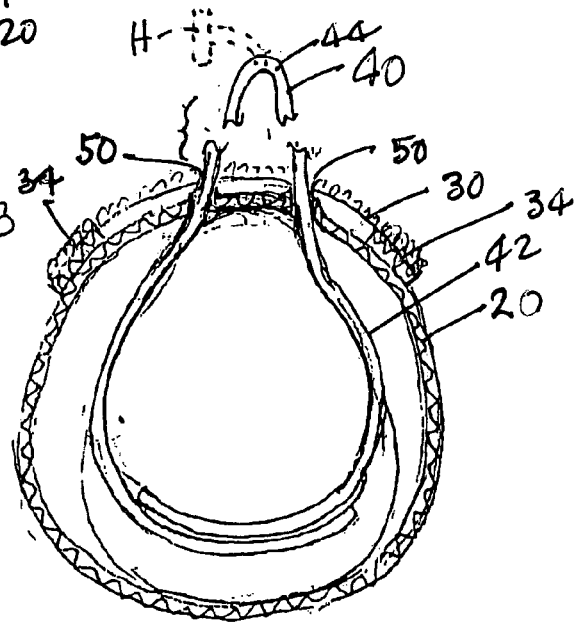
FIG. 3 is a fragmentary cross-section, as taken along line 3-3 in FIG. 1, in a direction indicated by arrows.

At each leg-covering portion 20, the drag harness 40 is made from a length of rope, as illustrated, or from a length of strap, and, as illustrated in broken lines in FIG. 3, may be optionally provided with an external handle H. The length of rope or strap is joined end-to-end by splicing, by stitching, or otherwise to form an inner portion 42 of the drag harness 40, through which portion 42 one leg of a wearer extends, when the protective garment is worn, and the length is passed through each of the pair of apertures 50 so as to form an outer portion 44 of the drag harness 40, which portion 44 a rescuer can grasp. Normally, when the drag harness 40 at each leg-covering portion 20 is not needed, the knee pad 30 at such leg-covering portion 20 covers the apertures 50 in said leg-covering portion 20.

Figure 2:
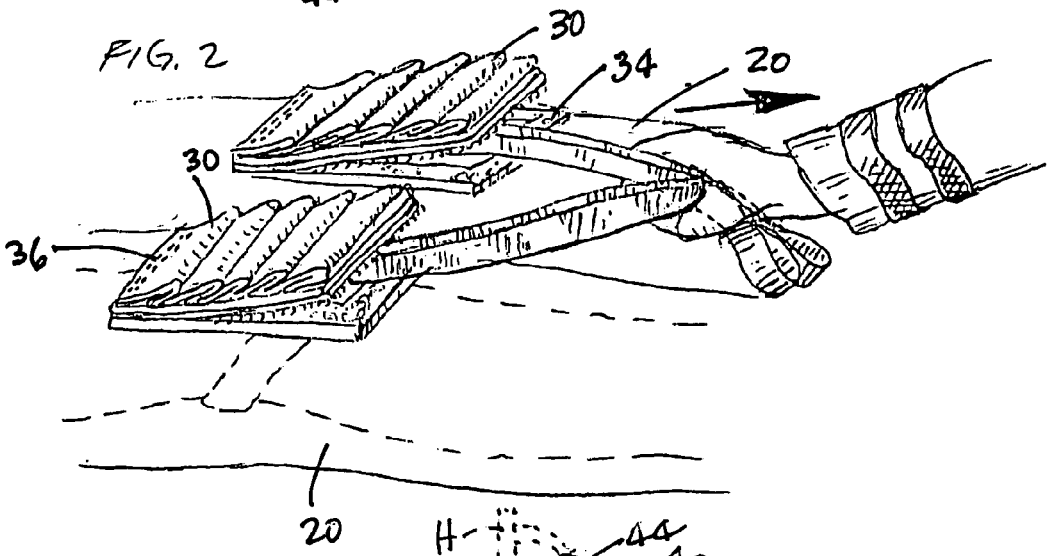
FIG. 2 is a similar view of an alternative embodiment of a protective garment embodying this invention.

In the embodiment of FIG. 1 and in the embodiment of FIG. 2, each knee pad 30 is manipulatable between a position where said knee pad 30 covers the pair of apertures 50 in the associated one of the leg-covering portions 20 and positions where said knee pad 30 does not cover the pair of apertures 50 in the associated one of the leg-covering portions 20.

In the embodiment of FIG. 1, the knee pad 30 at each leg-covering portion 20 is four-edged and is attached detachably at each of its edges 32, to said leg-covering portion 20, via hook-and-loop (e.g., Velcro™) fasteners 34. Thus, in the embodiment of FIG. 1, the knee pad 30 at each leg-covering portion 20 is attached to said leg-covering portion 20 so as to be completely detachable. Snap fasteners or other releasable fasteners may be alternative employed, rather than hook-and-loop fasteners.

In the embodiment of FIG. 2, in which the knee pad 30 at each leg-covering portion 20 serves not only as a knee pad but also as a flap, the knee pad 30 at each leg-covering portion 20 is four-edged and is attached detachably at three of its edges 32, to said leg-covering portion 20, via hook-and-loop (e.g., Velcro™) fasteners 34, and is sewn hingedly at its fourth edge 36, to said leg-covering portion 20. Snap fasteners or other releasable fasteners may be alternative employed, rather than hook-and-loop fasteners. In a simplified embodiment, an unpadded flap is substituted for each knee pad 30.

In a simplified embodiment, the outer portion 44 of each drag harness 40 passes through one such aperture 50 in a given one of the leg-covering portions 20, and the knee pad 30 associated with the same one of the leg-covering portions 20 is attached detachably, either as in the embodiment of FIG. 1 or as in the embodiment of FIG. 2, so as to cover said one aperture 50 in the give one of the leg-covering portions 20.

The invention claimed is:

1. A protective garment of a type worn by a firefighter or by an emergency rescue worker, and of a type having a lower torso-covering portion and two leg-covering portions, wherein the protective garment is equipped with a drag harness or drag harnesses, each drag harness being accessible through an aperture or apertures associated with said drag harness and located somewhere in a knee area of the leg-covering portions wherein, along with each drag harness, the protective garment is equipped with a knee pad, which is manipulatable between a position wherein the knee pad covers the aperture or apertures associated with said drag harness and positions wherein the knee pad does not cover the aperture or apertures associated with said drag harness.

2. The protective garment of claim 1, wherein the knee pad is attached to the leg-covering portion so as to be completely detachable.

3. The protective garment of claim 1, wherein the knee pad is attached to the leg-covering portion so as to be completely detachable, except for being attached hingedly to of the leg-covering portion, along an edge portion of the knee pad.

4. The protective garment of any one of claims 1 through 3, wherein the drag harness extends into the protective garment, through a single aperture associated with said drag harness.

5. The protective garment of any one of claims 1 through 3, wherein the drag harness extends into the protective garment, through a pair of apertures associated with said drag harness.

* * * * *